US007219516B2

(12) United States Patent
Rhyne et al.

(10) Patent No.: US 7,219,516 B2
(45) Date of Patent: May 22, 2007

(54) HEAT SETTING MACHINE WITH SEALING HEAD

(75) Inventors: Jeffrey Todd Rhyne, Belmont, NC (US); Edward Dean Smith, Jr., Dalton, GA (US); Robert Cone Miller, Jr., Dalton, GA (US); Joseph Andrew Gottberg, Mooresville, NC (US)

(73) Assignee: BMB Enterprises, Inc., Resaca, GA (US)

( * ) Notice: Subject to any disclaimer, the term of this patent is extended or adjusted under 35 U.S.C. 154(b) by 677 days.

(21) Appl. No.: 10/392,497

(22) Filed: Mar. 20, 2003

(65) Prior Publication Data

US 2003/0213270 A1 Nov. 20, 2003

Related U.S. Application Data

(60) Provisional application No. 60/381,336, filed on May 17, 2002.

(51) Int. Cl.
*D06B 3/01* (2006.01)

(52) U.S. Cl. ..... 68/5 D; 68/5 C

(58) Field of Classification Search ..... 68/5 D, 68/5 C; 8/149.3

See application file for complete search history.

(56) References Cited

U.S. PATENT DOCUMENTS 2,661,619 A * 12/1953 Helle ..... 68/6
2,873,597 A * 2/1959 Fahringer ..... 68/5 E
3,037,369 A * 6/1962 Leins et al. ..... 68/5 E
3,040,553 A * 6/1962 Rust, Jr. ..... 68/175
3,083,556 A * 4/1963 Leonard ..... 68/5 E
3,319,275 A * 5/1967 Fleissner ..... 8/149.3
3,429,015 A * 2/1969 McClure ..... 28/266
3,457,602 A * 7/1969 Couick et al. ..... 28/281
3,763,527 A * 10/1973 Yazawa ..... 28/266

(Continued)

FOREIGN PATENT DOCUMENTS

FR 2 453 927 A 11/1980
FR 2 594 860 * 8/1987
FR 2 594 860 A 8/1987

OTHER PUBLICATIONS

Carter, Bobby R., Jr.; New Advances in Superba Heatsetting Technology; Carpet Yarn Heat and Twist Setting Seminar; Jan. 31, 1996 & Feb. 1, 1996; Dalton, Georgia.

(Continued)

*Primary Examiner*—Frankie L. Stinson
(74) *Attorney, Agent, or Firm*—Adams Evans P.A.

(57) ABSTRACT

A continuous heat set line for setting yarn, having spaced-apart, elongate, tubular entrance and exit cooling chambers interconnected by an elongate intermediate steam heat-setting chamber communicating therewith. The entrance and exit cooling chambers and the intermediate heat-setting chamber collectively define a single longitudinally-extending axis along the combined length thereof. Sealing heads seal the entrance and exit cooling chambers and the intermediate heat-setting chamber to a degree sufficient to maintain a pressurized condition within the heat-setting chamber. A yarn conveyor extends through the pretreatment chamber for conveying the yarn through the entrance and exit cooling chambers and the heat-setting chamber. At least one piston and cylinder assembly moves sealing rolls into and out of position relative to each other, while independently-operating springs urge the rolls together sufficiently to effect a seal.

13 Claims, 16 Drawing Sheets

U.S. PATENT DOCUMENTS

| | | | | | |
|---|---|---|---|---|---|
| 3,918,111 | A | * | 11/1975 | Dunn | 8/149.1 |
| 3,927,540 | A | * | 12/1975 | Tanaka et al. | 68/5 E |
| 3,977,059 | A | * | 8/1976 | Ethridge et al. | 28/255 |
| 4,009,513 | A | * | 3/1977 | Andersen | 28/179 |
| 4,949,558 | A | | 8/1990 | Enderlin | |
| 5,024,390 | A | | 6/1991 | Enderlin | |
| 5,070,585 | A | | 12/1991 | Enderlin | |
| 5,092,139 | A | | 3/1992 | Runser | |
| 5,134,866 | A | | 8/1992 | Enderlin | |

OTHER PUBLICATIONS

Optiset; Continuous Yarn Heatsetting Range; The Cooper Company, Inc.; Dalton Georgia.

MF2; Friezing Machine (for carpet yarns) with Steam Injection Superba; Mulhouse, France.

TVP2S; The Evolution in Continuous Heat-Setting; Superba; Mulhouse, France.

CBS; Steam Circulation Blower System; Advantages; Technical Features; Superba; Mulhouse, France.

TVP; Heat-Setting of Carpet Yarns; Superba; Mulhouse, France.

200 mm Belt; Prior Art (Circa late 1970's); 260 mm Belt; Design by Superba.

TVP2S; Technical Sheet; Superba; Charlotte, NC and Mulhouse, France.

* cited by examiner

HEAT SETTING MACHINE WITH SEALING HEAD

TECHNICAL FIELD AND BACKGROUND OF THE INVENTION

This invention relates to a machine and process for heat setting yarn, principally, but not exclusively, carpet yarn. The machine conditions twisted yarns with saturated steam to increase the crystallinity of the yarn and lock the twist or the crimp into the yarn. The machine is a continuous process machine with yarn entering one end of the machine, moving downstream through the machine and exiting the downstream end properly treated and ready for the next production step—typically winding onto yarn packages in preparation for carpet tufting.

In general, the heat setting machine includes a coiler or other yarn-depositing device for depositing yarn on a moving conveyor which carries the yarn into a pretreatment chamber where the yarn is heated. The yarn then passes through a set of entrance sealing rolls which maintain a pressurized environment within the system. The yarn then passes into an entrance-cooling chamber where cool, dry air is circulated through the yarn, cooling the yarn to a uniform temperature and thus allowing redevelopment of the bulk in the yarn. This cooling chamber also protects the sealing rolls from the higher temperature of the heating chamber.

The yarn then passes into a heating chamber where a homogeneous mixture of steam and air is circulated through the yarn. The yarn exits the heating chamber into an exit-cooling chamber where cool dry air is circulated through the yarn to reduce the yarn temperature, remove excess moisture, and protect a set of exit sealing rolls which cooperate with the entrance sealing rolls to maintain a pressurized environment within the system. The yarn then passes through the exit sealing rolls and can be further dried, separated and wound onto packages on a take-up winder which runs in synchronization with the remaining components. A yarn accumulator can be part of the system, allowing the system to continue operating during winder doffing cycles.

Several features are provided which differentiate the machine and method disclosed in this application from prior art machines. These features include a tunnel wherein two cooling chambers on either end of a heating chamber communicate in alignment with each other along an axis extending the length of the combined cooling and heating chambers. There is no offset from one zone to the other. This permits less expensive manufacturing and a wider conveyor belt for transporting the yarn through the system.

The novel system also includes an entrance and exit set of sealing rollers which maintain the pressure in the system. These sets of rollers are moved into and out of sealing position by a novel power-assist assembly such as pneumatic or hydraulic cylinders. The rollers are locked into sealing with each other by a mechanical locking device that takes the load off of the power-assist assembly and places the load onto heavy springs which provide the resilience necessary to perform the sealing function while permitting the yarn to pass between the rollers into and out of the heating chamber.

The invention can also include an exterior heat exchanger.

SUMMARY OF THE INVENTION

Therefore, it is an object of the invention to provide a continuous heat set tunnel for setting yarn.

It is another object of the invention to provide a continuous heat set line that has a conveyor that extends generally along the lateral centerline of the heat set tunnel to thereby provide for an increased conveyor width.

It is another object of the invention to provide a continuous heat set line with sealing head rolls that are moved into and out of sealing position by at least one piston and cylinder assembly.

It is another object of the invention to provide a continuous heat set line with sealing head rolls that are pressurized against each other by springs operating independently of the piston and cylinder assembly.

These and other objects of the present invention are achieved in the preferred embodiments disclosed below by providing a continuous heat set line for setting yarn, comprising spaced-apart, elongate, tubular entrance and exit cooling chambers interconnected by an elongate intermediate steam heat-setting chamber communicating therewith. The entrance and exit cooling chambers and the intermediate heat-setting chamber collectively defining a single longitudinally-extending axis along the combined length thereof. A steam injector is provided for injecting steam at a predetermined pressure into the heat-setting chamber. Sealing means are provided for sealing the entrance and exit cooling chambers and the intermediate heat-setting chamber to a degree sufficient to maintain pressurized condition within the heat-setting chamber. A steam pretreatment chamber is positioned upstream of the entrance cooling chamber for applying a conditioning charge of steam to the yarn before it enters sealing rolls of the entrance cooling chamber. A yarn conveyor extends through the pretreatment chamber for conveying the yarn through the entrance and exit cooling chambers and the heat-setting chamber. A yarn depositing apparatus deposits the yarn in a uniform manner on the yarn conveyor upstream of the pretreatment chamber.

According to one preferred embodiment of the invention, the yarn depositing apparatus comprises a yarn coiler for depositing uniform, overlapping coils of yarn on the yarn conveying apparatus.

According to another preferred embodiment of the invention, the yarn conveying apparatus comprises an endless permeable conveyor belt extending from the coiler to downstream of the exit cooling chamber.

According to another preferred embodiment of the invention, a yarn packaging apparatus is provided for removing the yarn from the yarn depositing apparatus and forming the yarn into a package suitable for further downstream processing.

According to yet another preferred embodiment of the invention, the sealing means comprises an entrance sealing roll apparatus positioned upstream of the entrance cooling chamber and an exit sealing roll apparatus positioned downstream of the exit cooling chamber for sealing, respectively, the upstream end of the entrance cooling chamber and the downstream end of the exit cooling chamber, each of the entrance and exit sealing roll apparatuses including a pair of sealing rolls positioned adjacent each other for allowing yarn on the conveying apparatus to pass therebetween while preventing the escape of pressurized steam from within the entrance and exit cooling chambers and the intermediate steam heat-setting chamber.

According to yet another preferred embodiment of the invention, the yarn conveyor extends through the entrance and exit cooling chambers and the intermediate heat-setting chamber at a position functionally equidistant from a top and bottom wall thereof.

According to yet another preferred embodiment of the invention, the sealing means comprises a frame defining an opening through which the conveyor extends, a bottom sealing roll assembly carried by the frame, including a rotatably-mounted bottom sealing roll positioned below the conveyor, and a top sealing roll assembly carried by the frame, and including a rotatably-mounted top sealing roll mounted in spaced-apart relation to the bottom sealing roll above the conveyor whereby the conveyor extends between the bottom sealing roll and the top sealing roll for carrying the yarn past the top and bottom sealing roll assemblies and into the entrance cooling chamber. At least one piston and cylinder assembly interconnects the frame and the top sealing roll assembly for moving the top sealing roll assembly between an opened position, and a closed position wherein the top roll rests against the bottom roll. Pressurizing means exert sufficient pressure on the top roll to seal the top roll against the conveyor and the yarn carried thereon as the conveyor is supported by the bottom roll.

According to yet another preferred embodiment of the invention, the pressurizing means comprises springs carried by the frame for resiliently biasing the top roll against the yarn and conveyor when in its closed position.

According to yet another preferred embodiment of the invention, the sealing means includes lateral seals positioned to contact and seal against radially-extending end walls of the top roll and the bottom roll.

According to yet another preferred embodiment of the invention, a locking lever is provided for urging the top roll into contact with the conveyor.

According to yet another preferred embodiment of the invention, a locking pin is provided for locking the locking lever into a position with the top roll urged into contact with the conveyor.

According to yet another preferred embodiment of the invention, a top lamella sealingly engages the top roll along the length thereof to prevent the escape of steam and pressure past the top roll and a bottom lamella sealingly engages the bottom roll along the length thereof to prevent the escape of steam and pressure past the bottom roll.

According to yet another preferred embodiment of the invention, a sealing head is provided for sealing an end opening of a heat set line for setting yarn, and comprises a bottom sealing roll frame mounted adjacent the end opening and carrying a rotatably-mounted bottom sealing roll, and a top sealing roll frame carrying a rotatably-mounted top sealing roll, the top sealing roll frame mounted on the bottom sealing roll frame for movement between an open, non-sealing position and a closed sealing position with the top roll engaging a yarn conveyor extending between the top and bottom rolls and into the heat set line for conveying the yarn into the heat set line. At least one piston and cylinder assembly interconnects the top and bottom sealing roll frames for power-assisted movement of the top sealing roll frame between the open and closed positions.

According to yet another preferred embodiment of the invention, pressurizing springs are carried by the top sealing roll frame for resiliently biasing the top roll against the conveyor when in its closed, sealing position.

According to yet another preferred embodiment of the invention, lateral seals are positioned to contact and seal against radially-extending end walls of the top roll and the bottom roll.

According to yet another preferred embodiment of the invention, a locking lever is provided for urging the top roll into contact with the conveyor.

According to yet another preferred embodiment of the invention, a locking pin is provided for locking the locking lever into a position with the top roll urged into contact with the conveyor.

According to yet another preferred embodiment of the invention, a top lamella sealingly engages the top roll along the length thereof to prevent escape of steam and pressure from the heat set line past the top roll and a bottom lamella sealingly engages the bottom roll along the length thereof to prevent the escape of steam and pressure past the bottom roll.

According to yet another preferred embodiment of the invention, the at least one piston and cylinder assembly comprises a pair of piston and cylinder assemblies interconnecting the top sealing roll frame and the bottom sealing roll frame on opposite lateral sides thereof for balanced movement of the top sealing roll frame relative to the bottom sealing roll frame.

According to yet another preferred embodiment of the invention, the pair of piston and cylinder assemblies are hydraulically powered.

According to yet another preferred embodiment of the invention, the end opening comprises an entrance to the heat set line and the sealing head is positioned upstream of the entrance for sealing the entrance against loss of pressure and steam.

According to yet another preferred embodiment of the invention, the end opening comprises an exit from the heat set line and the sealing head is positioned downstream of the exit for sealing the exit against loss of pressure and steam.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
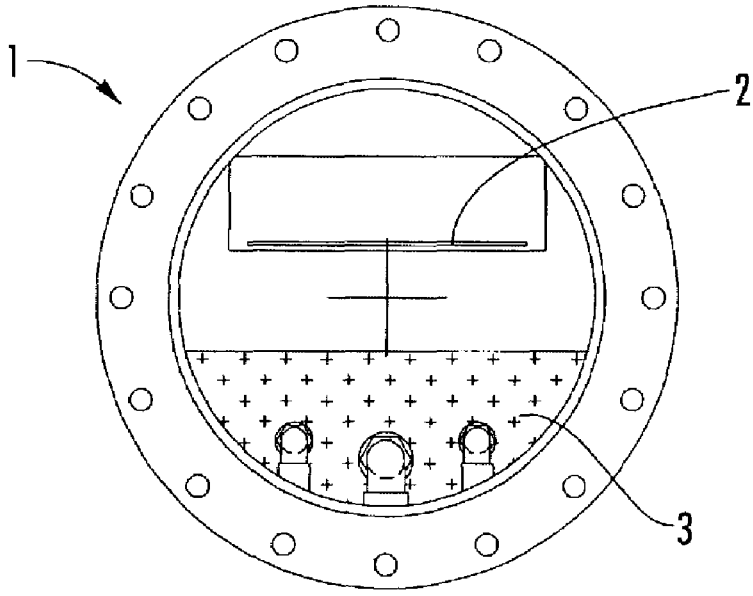
FIG. 1. PRIOR ART
FIG. 1 is a vertical cross-section of a prior art heating tunnel.

Referring now specifically to the drawings, a cross-section of a portion of a tubular heat set tunnel according to a prior art design is illustrated in FIG. 1 at reference numeral 1. The section represents the configuration of a central portion of the tunnel wherein the belt 2 is 260 mm wide and resides 50 mm above the centerline of the tunnel section 1. The belt 2 is positioned 100 mm above the waterline. Positioning the belt above the centerline of the tunnel section 1 limits the width of the belt to a width less than would be possible at the centerline diameter of the tunnel. This design, described in U.S. Pat. No. 5,092,139, discloses positioning the central heating chamber with a longitudinally-extending axis which is disposed lower than the cooling chambers on either end, having the effect of moving the belt in the heat setting tunnel closer to the longitudinally-extending axis of the heat setting tunnel, but still above the centerline by approximately ⅙ to 1/10 the diameter of the chamber. The '139 patent teaches that this arrangement is essential.

Figure 2A:
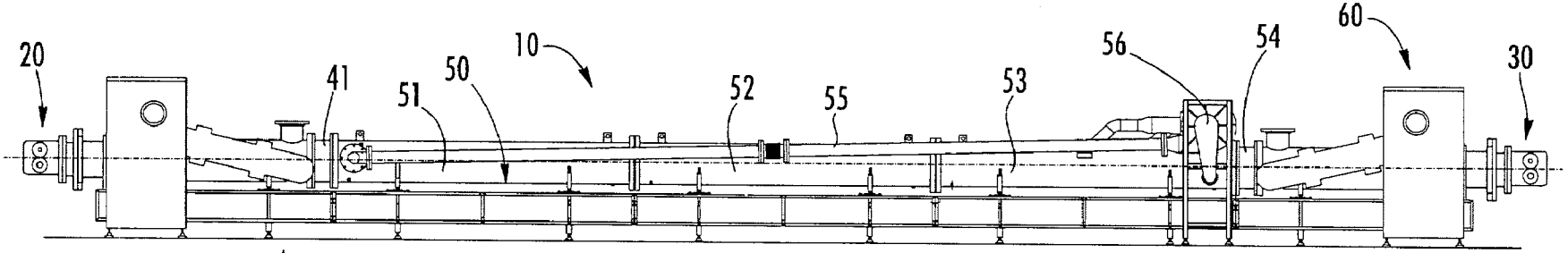
FIG. 2A is a side elevation of a heat set tunnel according to the present invention.
Figure 2B:
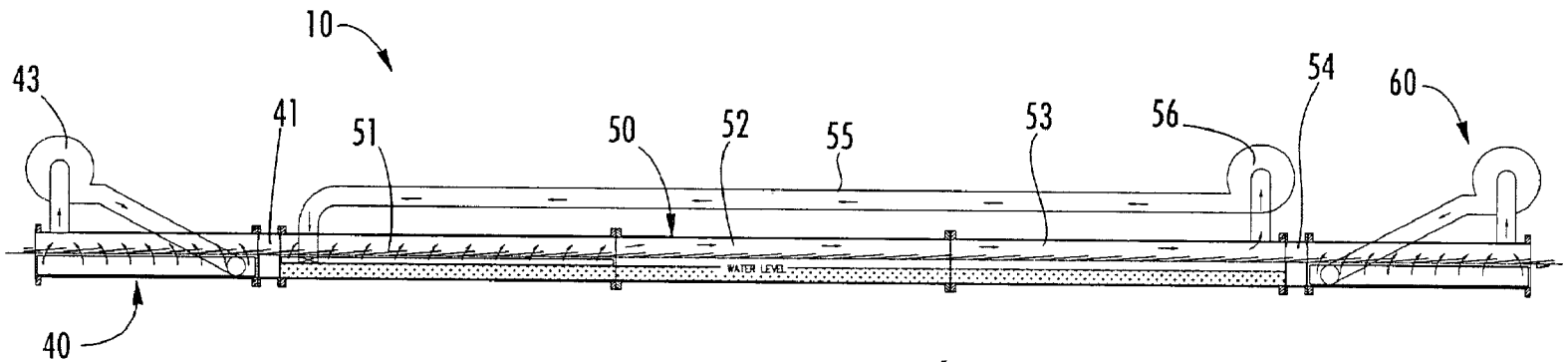
FIG. 2B is a vertical cross-sectional view of a heat seat tunnel according to the invention.

The invention according to the present invention is disclosed in FIGS. 2–18, inclusive. As is shown in FIGS. 2A and 2B, the heat set tunnel 10 according to the invention extends longitudinally along a supporting floor surface and includes on one end an entrance sealing roll assembly 20 and on the other end an exit sealing roll assembly 30. Downstream of the entrance sealing roll assembly 20 is an entrance cooling section 40 connected by a cool/heat transition 41 to a steaming chamber 50 comprised of tubular elongate entry, intermediate and exit heat set tunnel segments 51, 52 and 53, respectively. A heat/cool transition 54 interconnects the exit heat set tunnel segment 53 with an exit cooling section 60.

The entrance cooling section 40 includes an exterior heat exchanger 42 which takes heated yarn from a pre-treatment steaming chamber, not shown, and circulates cool, dry air through the yarn by means of a fan 43, cooling the yarn to a uniform temperature and allowing bulk to redevelop in the yarn after passing under the rolls of the sealing roll assembly 20. See FIG. 7. The yarn then passes through the cool/heat transition 41 and into the entry heat set tunnel segment 51 where the yarn is heated again by live steam and heated air to a temperature sufficient to set the bulk in the yarn. Air and steam is circulated through the tunnel segments 51, 52 and 53 by an exterior recirculation conduit 55 and a fan 56.

The treated yarn passes through the heat/cool transition 54 into the exit cooling section which cools the yarn as it protects the rolls of the exit sealing roll assembly 30. The yarn is then conveyed to a winder where the yarn is packaged on suitable yarn packages and is ready for further processing.

Figure 3:
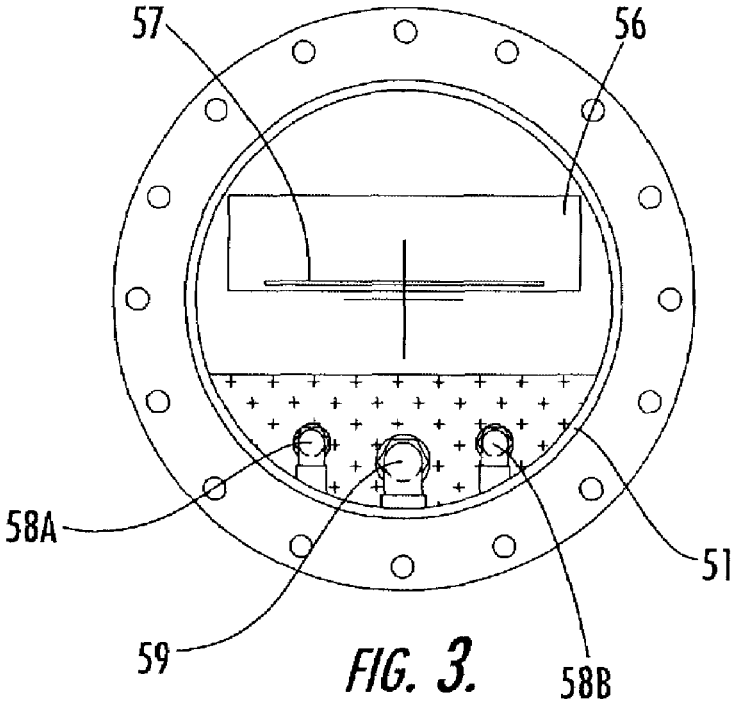
FIG. 3 is a vertical cross section of a heating tunnel according to one embodiment of the invention.

The preferred embodiment of the heat set tunnel segment 51 is shown in FIG. 3, and is exemplary of tunnel segments 52 and 53. A sheet metal drip shield 56 extends along the upper extent of the tunnel segment 51 and encloses a conveyor belt 57 which extends the length of the heat set tunnel 10. In the lower portion of the tunnel segment 51 are two longitudinally-extending closed steam coils 58A and 58B which are used to bring water in the lower portion of the tunnel 51 up to temperature. At this point these coils 58A and 58B are shut off and live steam is introduced into the tunnel segment 51 through a perforated sparger 59. Note that the conveyor belt 57 extends very nearly along the diameter of the tunnel segment 51.

Figure 4:
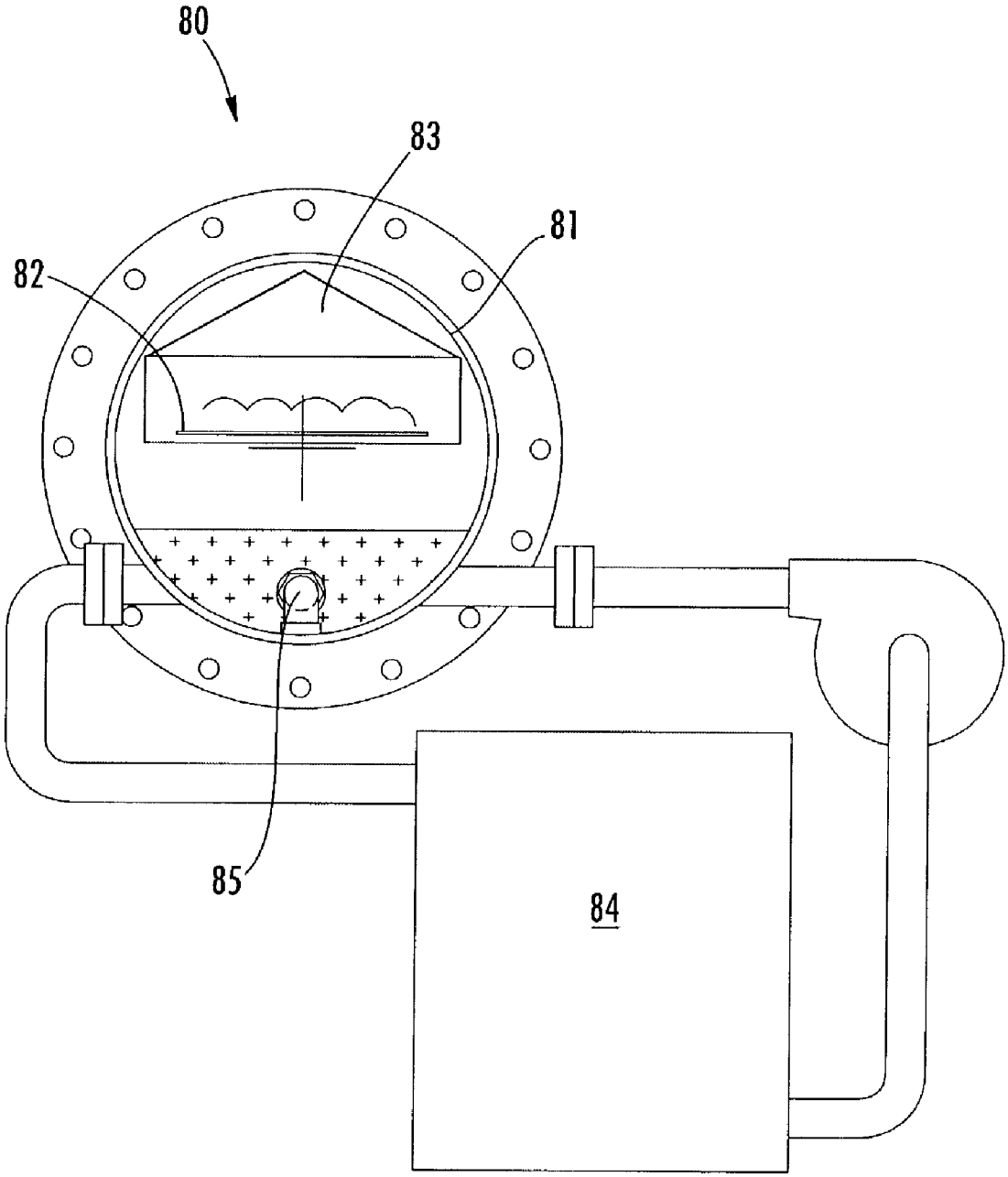
FIG. 4 is a vertical cross section of a heating tunnel according to another embodiment of the invention including an external heat exchanger.

Another embodiment of a tunnel segment is shown in FIG. 4 at reference numeral 80, and includes an elongate tubular enclosure 81 within which is located a conveyor 82 within a sheet metal drip shield 83. Water in the bottom of tunnel segment 80 is heated to temperature by a circulating external heat exchanger 84. A sparger 85 then supplies live steam to the tubular enclosure 81.

Figure 5:
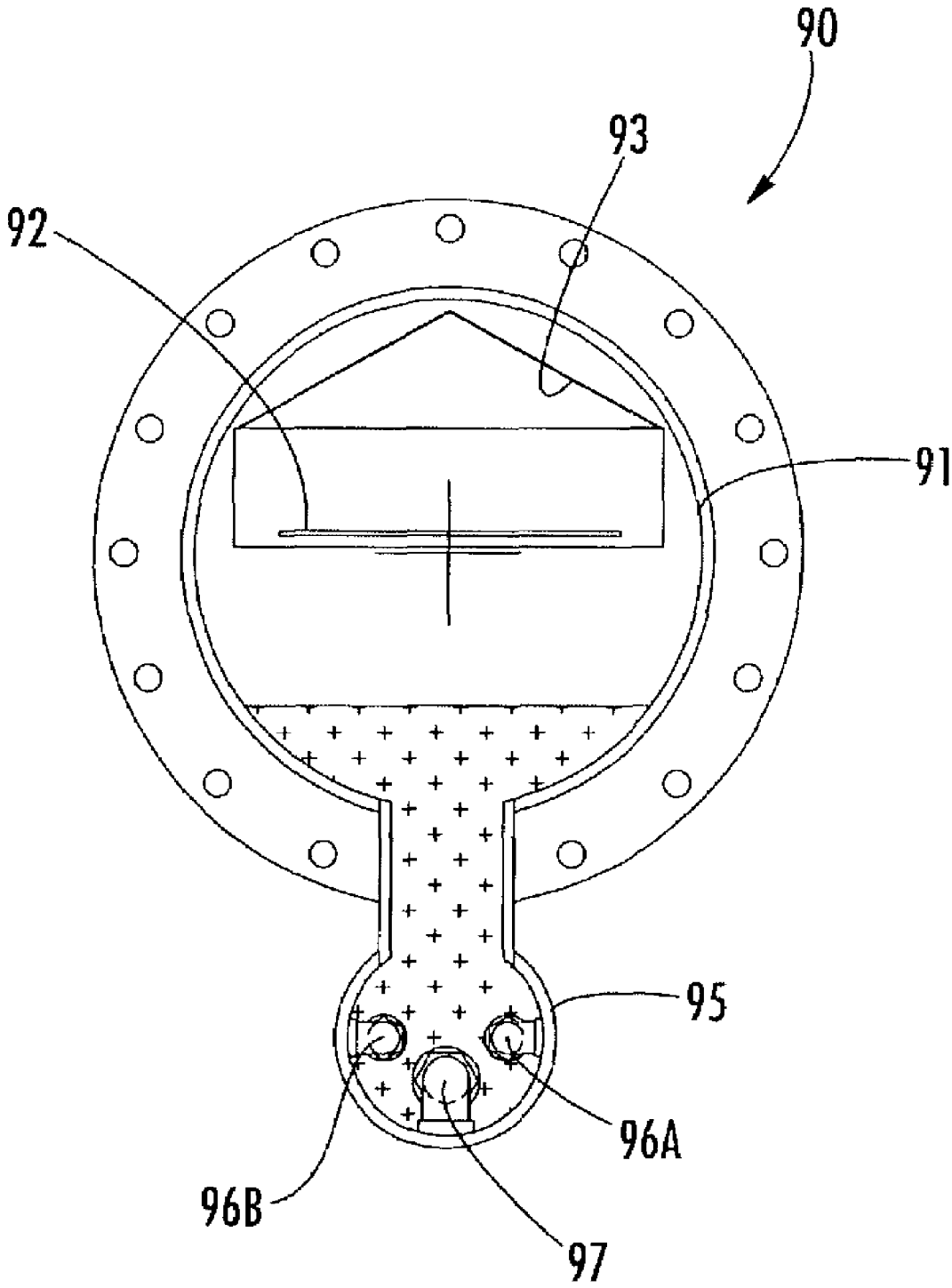
FIG. 5 is a vertical cross section of a heating tunnel according to another embodiment of the invention including an external sump.

Another embodiment of a tunnel segment is shown in FIG. 5 at reference numeral 90, and includes an elongate tubular enclosure 91 within which is located a conveyor 92 within a sheet metal drip shield 93. Water in the bottom of tunnel segment 80 is heated to temperature in a sump 95 in which is contained two closed steam coils 96A, 96B and a sparger 97. After the water has been brought up to proper temperature, the sparger 97 then supplies live steam to the tubular enclosure 91.

Figure 6:
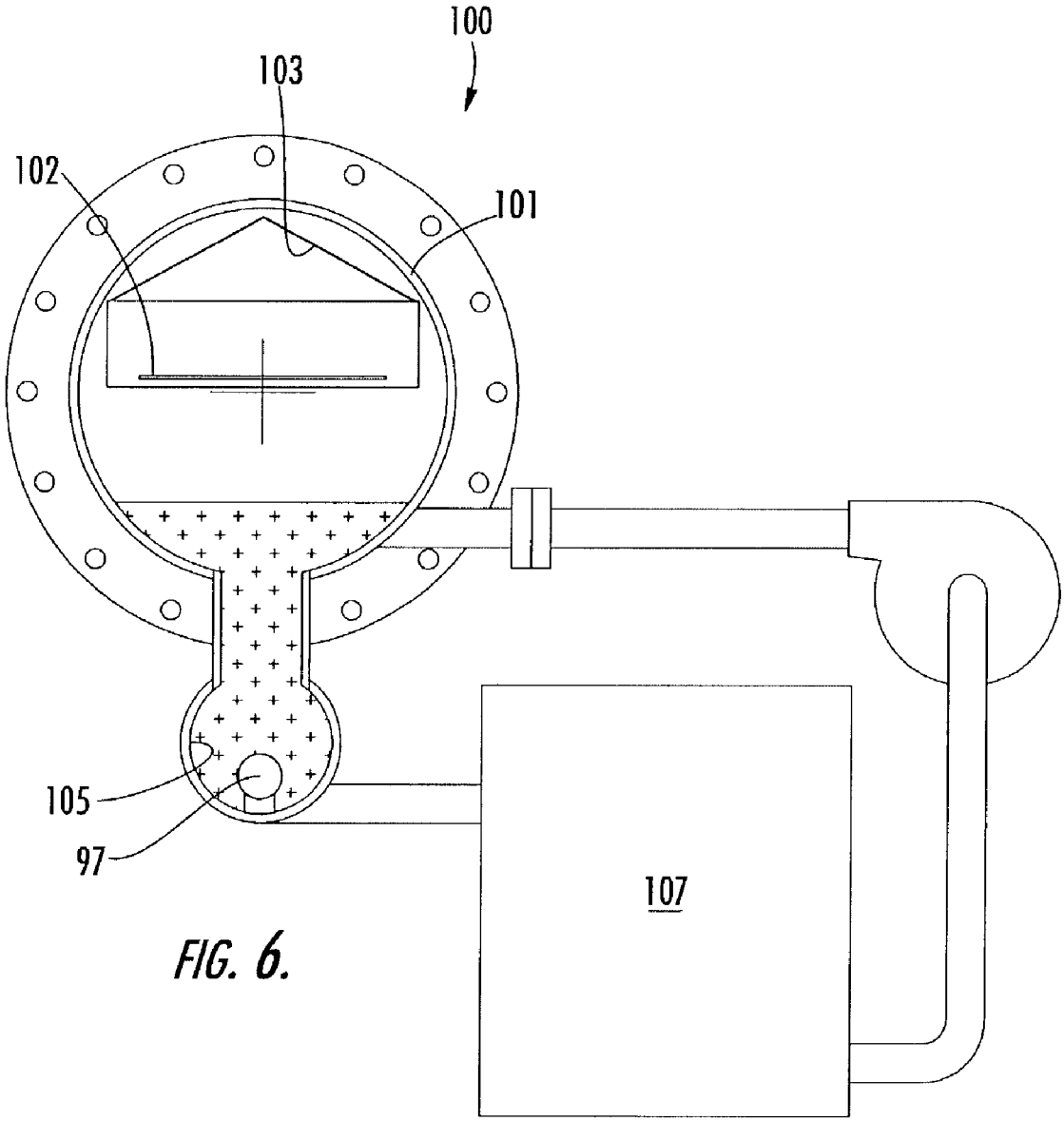
FIG. 6 is a vertical cross section of a heating tunnel according to another embodiment of the invention including an external sump and an exterior heat exchanger.
Figure 7:
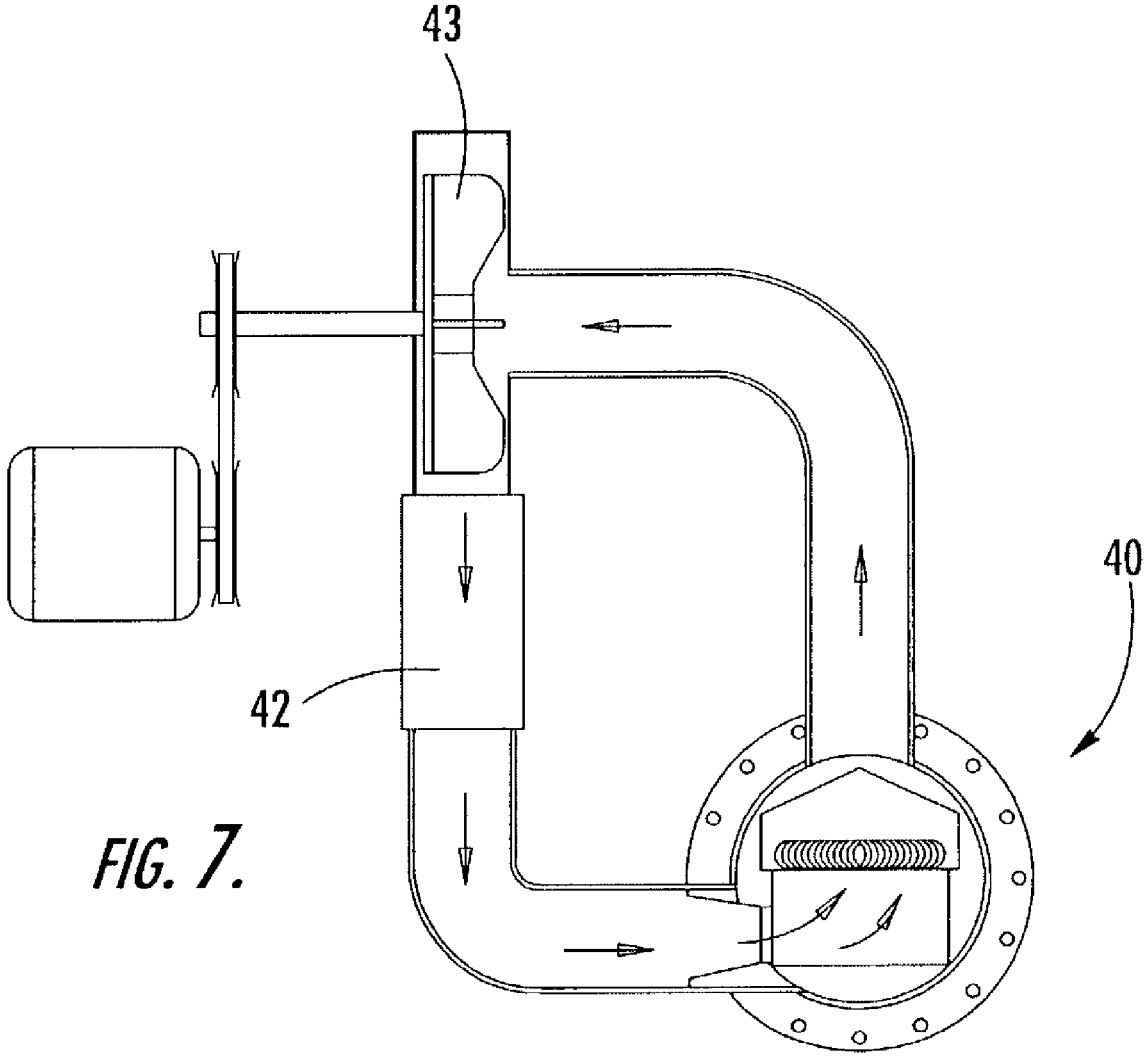
FIG. 7 is a vertical cross-section of the exit and entrance cooling sections.

Another embodiment of a tunnel segment is shown in FIG. 6 at reference numeral 100, and includes an elongate tubular enclosure 101 within which is located a conveyor 102 within a sheet metal drip shield 103. Water in the bottom of tunnel segment 80 is heated to temperature in a sump 105 by means of an external heat exchanger 107. A sparger 97 then supplies live steam to the tubular enclosure 91 to properly set the bulk in the yarn.

The entrance roll sealing assembly 20 is shown in FIGS. 8*a* through 9*f*. The exit roll sealing assembly 30 has the same construction. The entrance roll sealing assembly 20 includes an entrance opening 120 through which the conveyor 57 passes into the entrance cooling section 40. A bottom sealing roll frame 121 mounts bottom drive gears 122A, 122B, the shaft of which carries a bottom sealing roll 123 and hydraulic cylinder assemblies 124A, 124B. Piston rods 125A, 125B of the respective hydraulic cylinder assemblies 124A, 124B are pivotally connected to the top sealing roll frame 126. The top sealing roll frame 126 is pivotally mounted to the bottom sealing roll frame 121 by a pivot shaft 127. The distance and angle between the pivot of the piston rods 125A, 125B and the pivot shaft 127 provides a lever arm which permits the top sealing roll frame 126 to be moved between a closed position, FIGS. 8*a*, 8*b*, and an open position, FIGS. 8*c*, 8*d*, by the actuation of the hydraulic cylinder assemblies 124A, 124B. While it is presently believed that hydraulic cylinders will best perform the function described above, pneumatic cylinders, worm gears, ball screw gears or other power assist mechanisms are also possible.

Figure 8A:
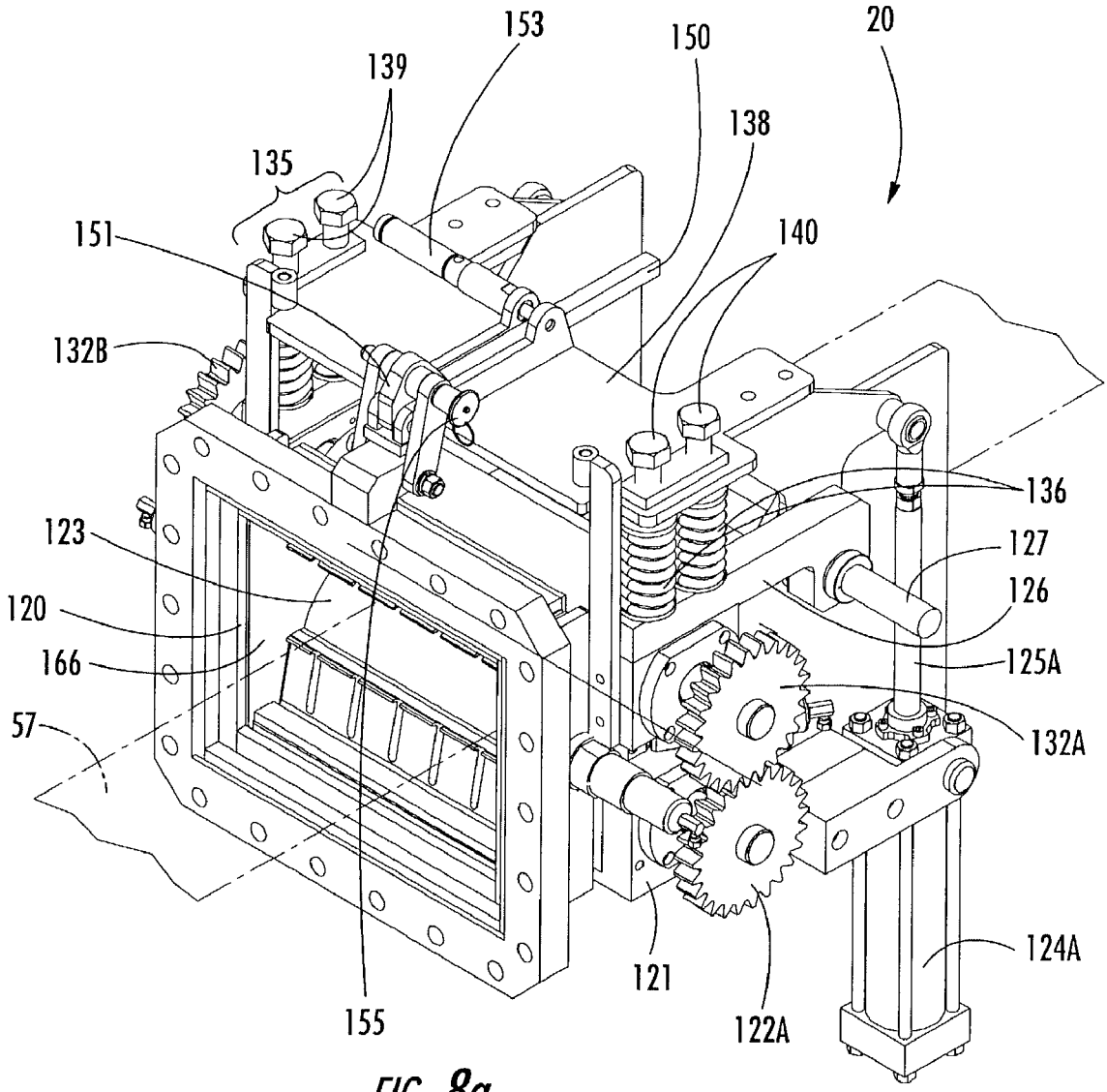
FIGS. 8*a*–8*d* shows four views of the of the entrance and exit sealing head.
Figure 8B:
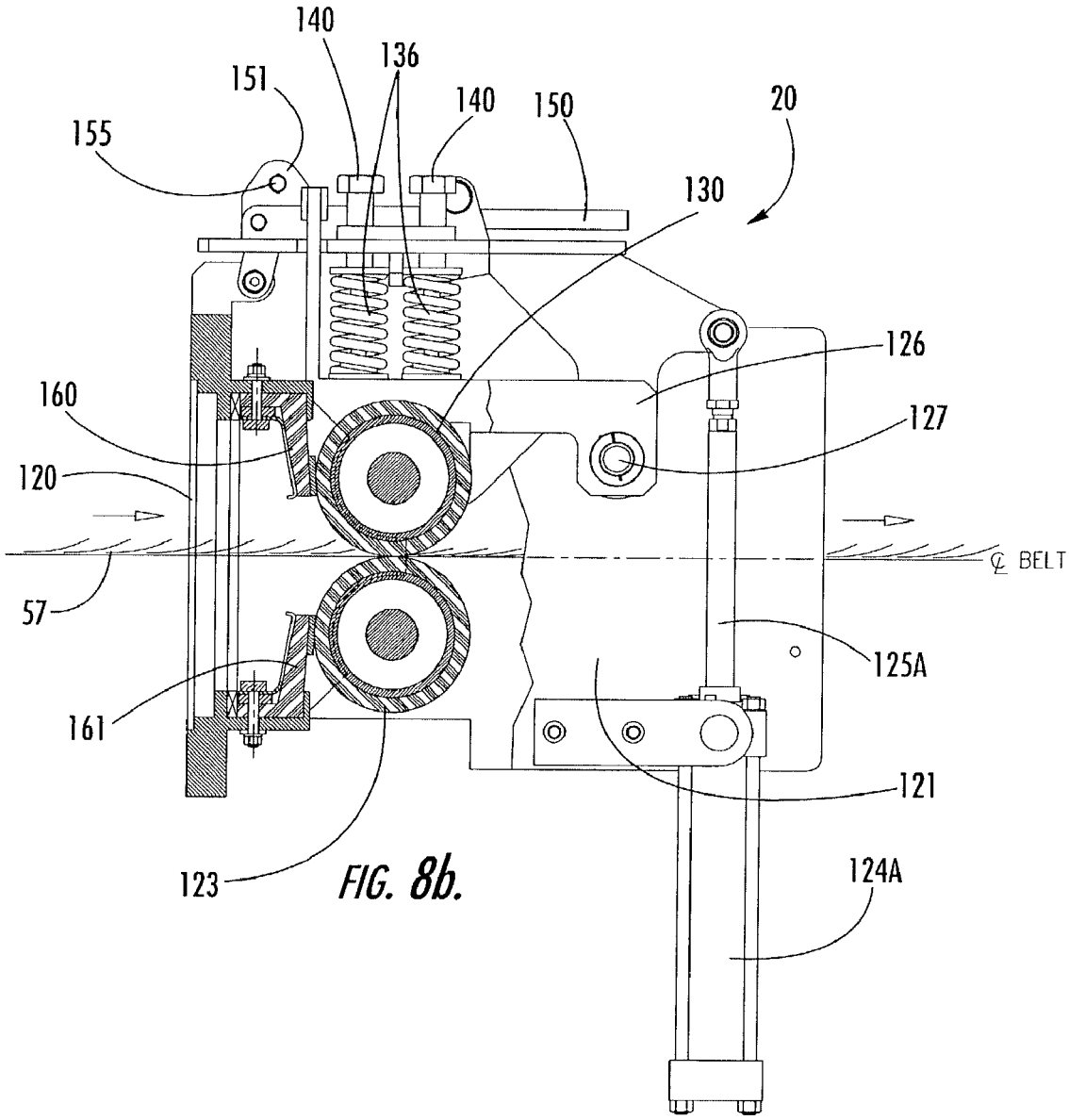
Figure 8C:
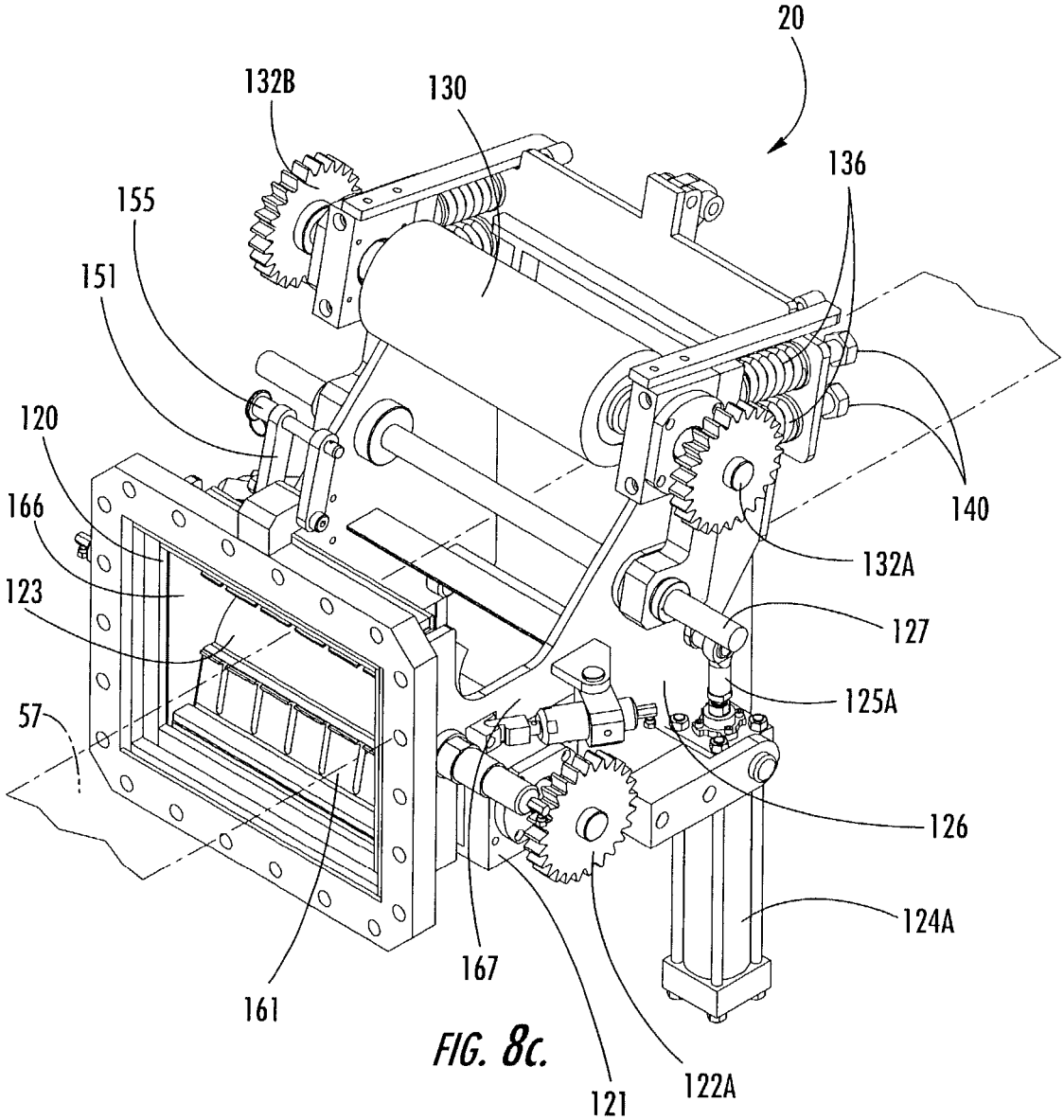
Figure 8D:
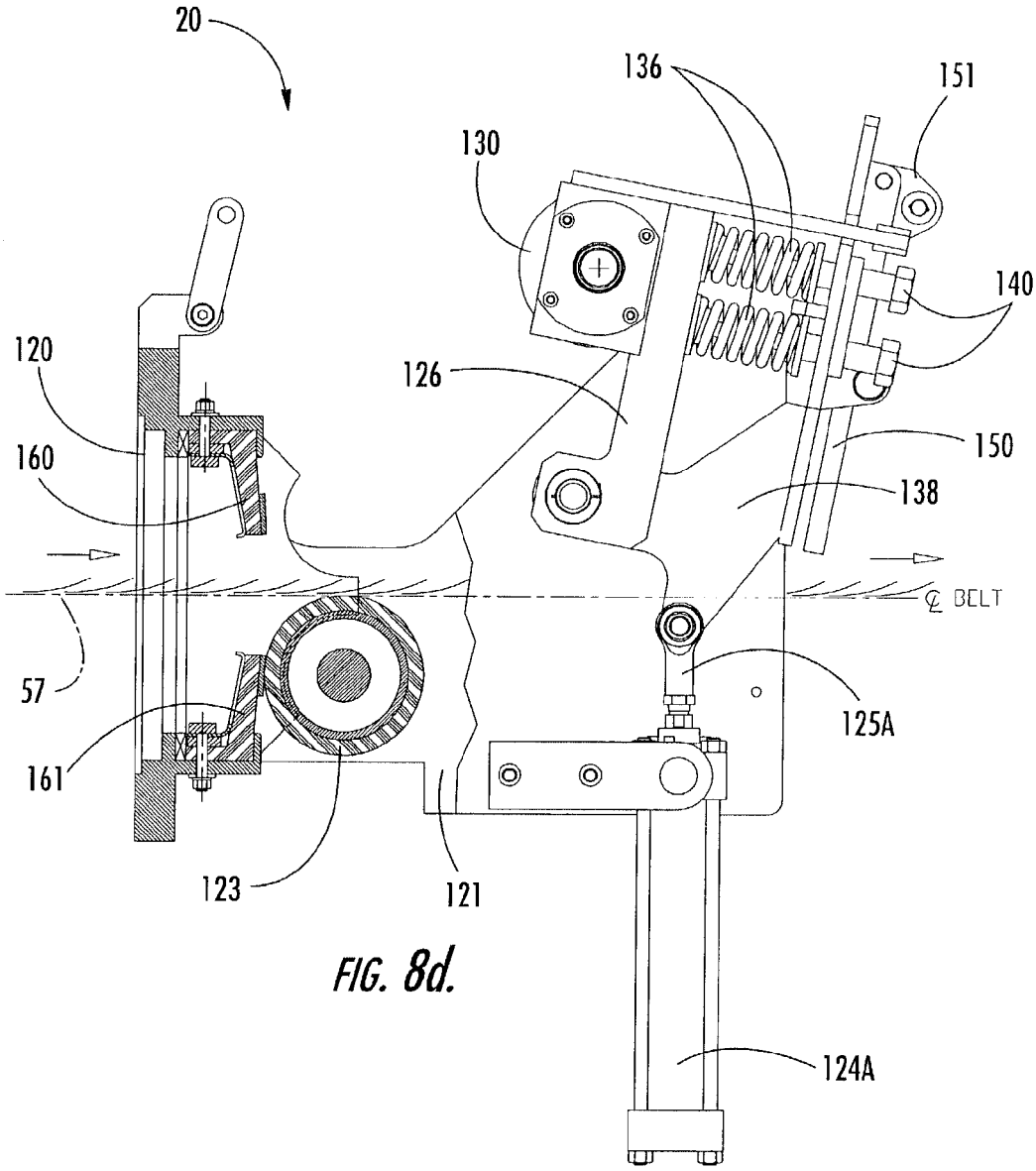

The top sealing roll frame 126 carries a top sealing roll 130, FIGS. 8*b*, 8*c* which is rotated by driven gears 132A, 132B meshed with and driven by drive gears 122A, 122B. The rolls 123 and 130 thus rotate against each other and provide a seal along their length, preventing the escape of pressure in the heating tunnel segments 51, 52, 53.

The sealing pressure against the rolls 123 and 130 necessary to prevent the escape of pressure is provided by opposed sets of heavy steel springs 135, 136 mounted between the top sealing roll frame 126 and a top pressure plate 138. Adjustment screws 139 and 140 permit adjustment of the springs to the correct pressure to seal the rolls 123 and 130 against each other while not creating so much pressure that the roll bearings are damaged.

The hydraulic cylinders 124A, 124B serve only to raise and lower the top sealing roll frame 126 relative to the bottom sealing roll frame 121. When, for example, the top sealing roll frame 126 has been lowered onto the bottom sealing roll frame 121 by the hydraulic cylinders 124A, 124B, pressure is applied to the rolls 123, 130 by means of a locking lever 150 which is manually urged into a locking link assembly 151. See FIG. 9*b*. A locking cylinder 153 locks the locking lever 150 in its locked position, and a link pin 155 locks the locking link assembly 151 in its down, sealing and locked position.

As is best shown in FIG. 8*b*, top and bottom lamellas 160, 161 are urged against the front side of the top and bottom sealing rolls 130, 123, respectively, and seal against pressure escaping around the top of the top roll 130 and the bottom roll 123. Similarly, side cylinders 163, 164 urge side pressure plates 166, 167 against the opposed ends of the sealing rolls 123, 130 to prevent pressure leaks past the ends of the rolls 123, 130. See FIG. 9*d*.

Figure 9A:
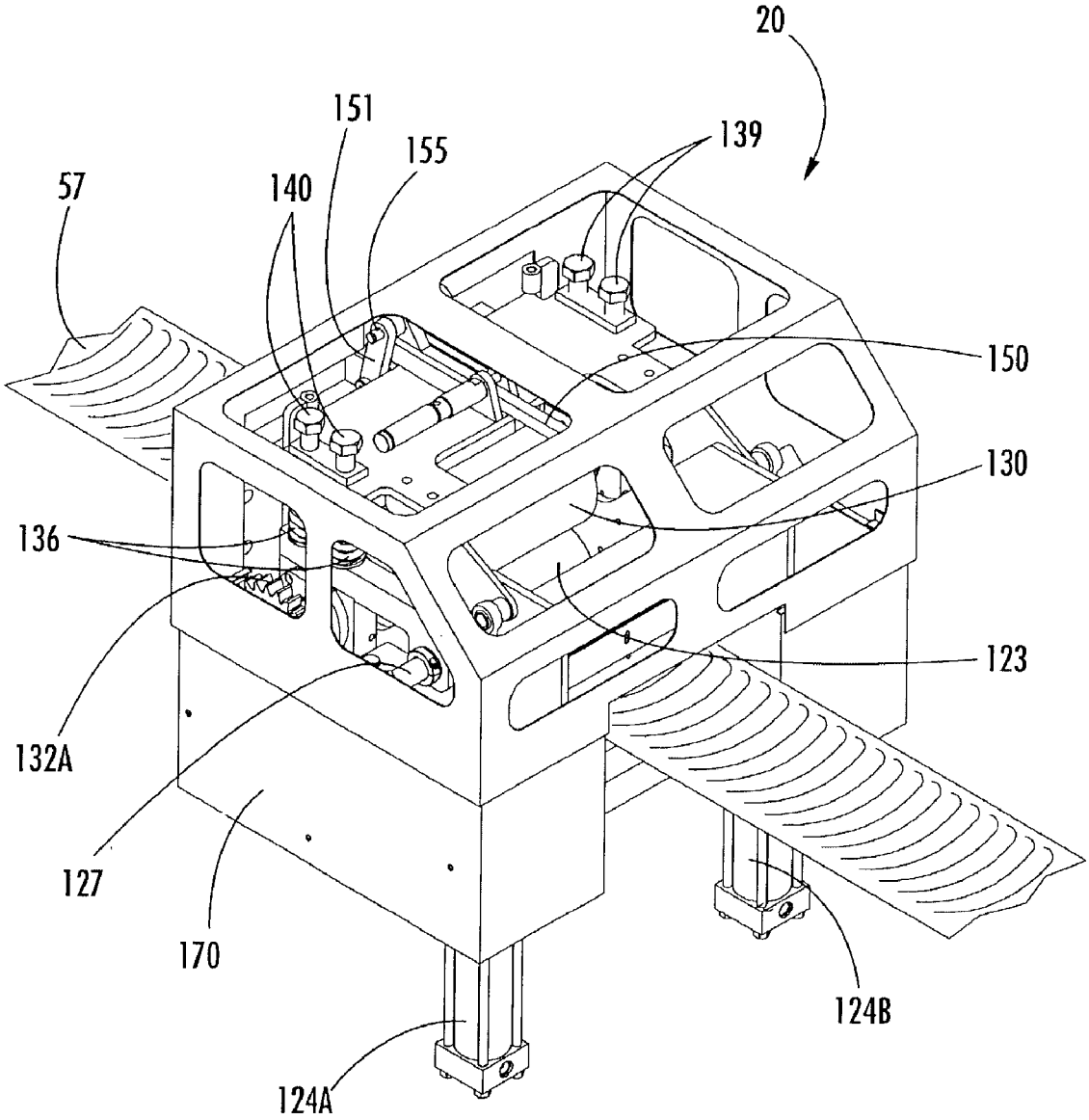
FIG. 9*a* is a perspective view of the sealing head in the closed, sealing position.
Figure 9B:
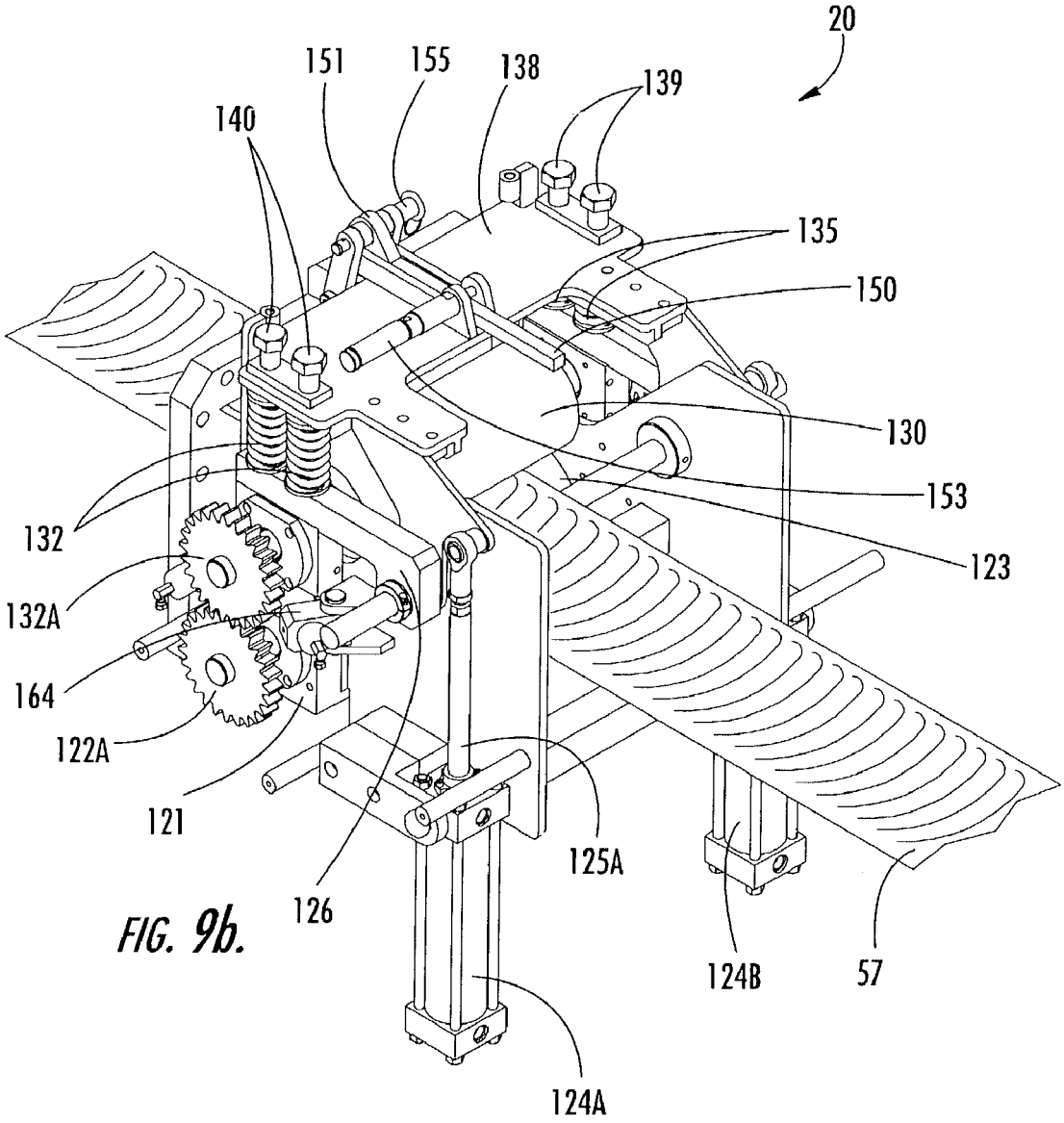
FIG. 9*b* is a perspective view from the rear of the sealing head in the closed, sealing position.
Figure 9C:
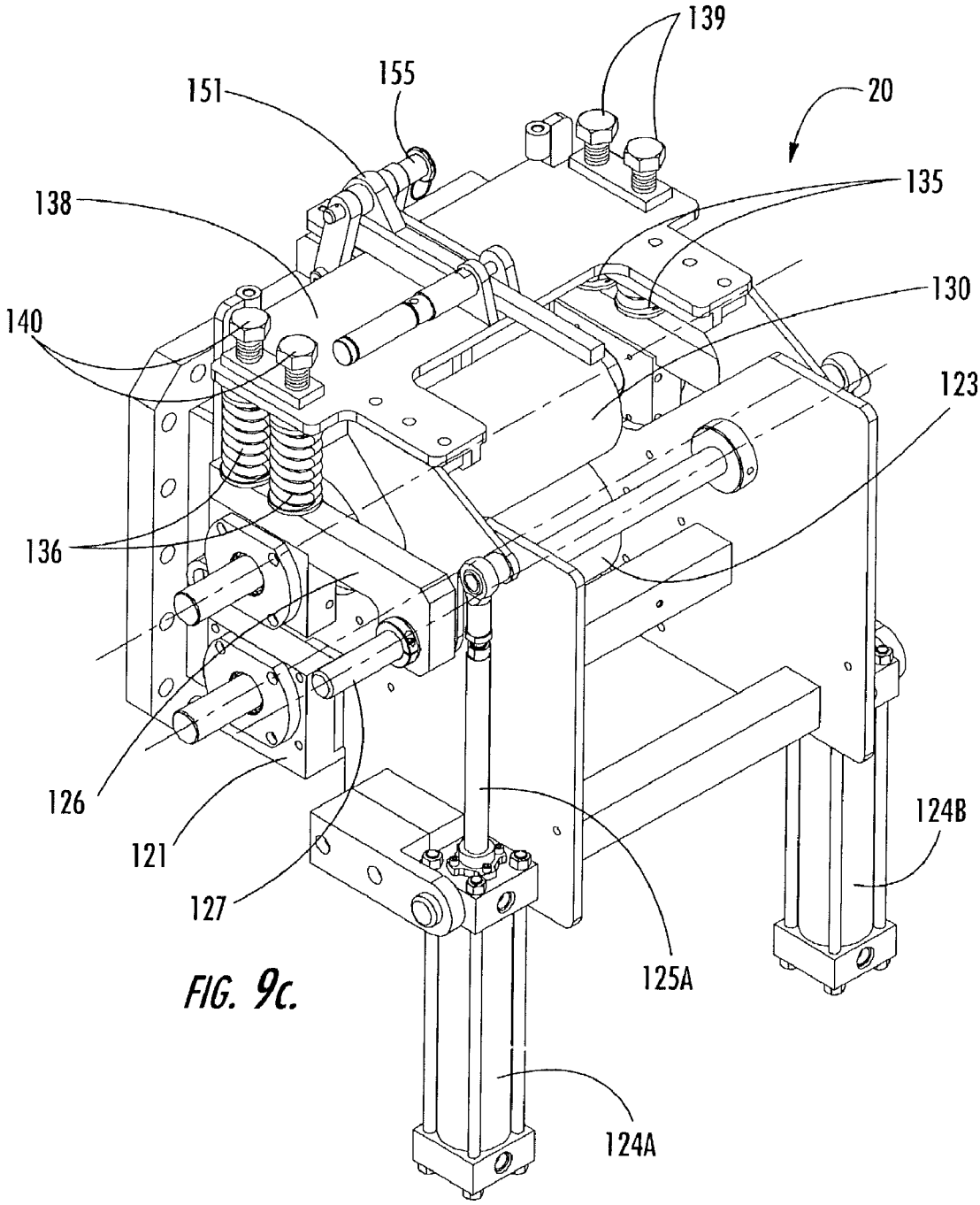
FIG. 9*c* is perspective view from the rear of the sealing head in the closed, sealing position, with parts removed for clarity.
Figure 9D:
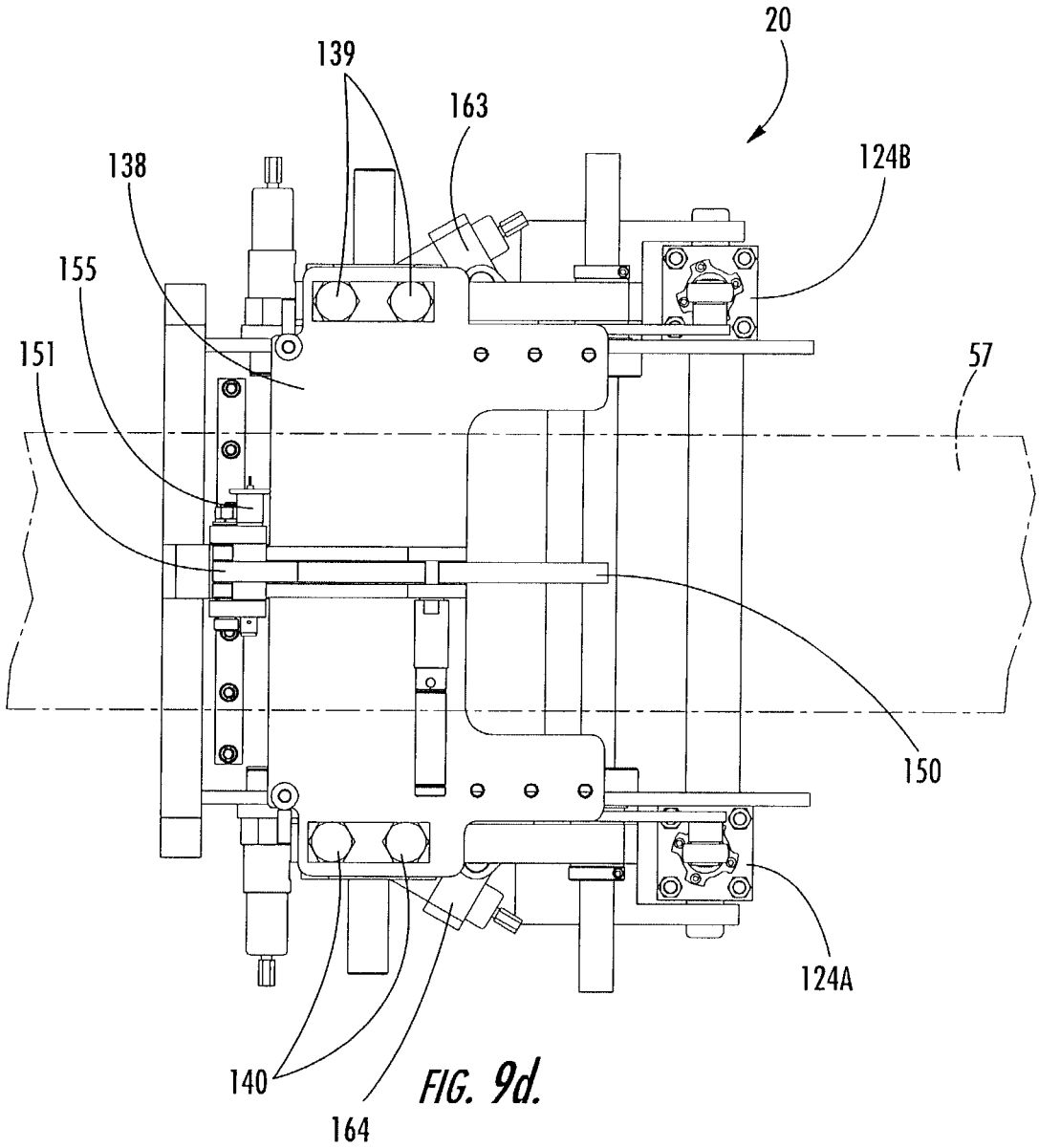
FIG. 9*d* is a top plan view of the sealing head.
Figure 9E:
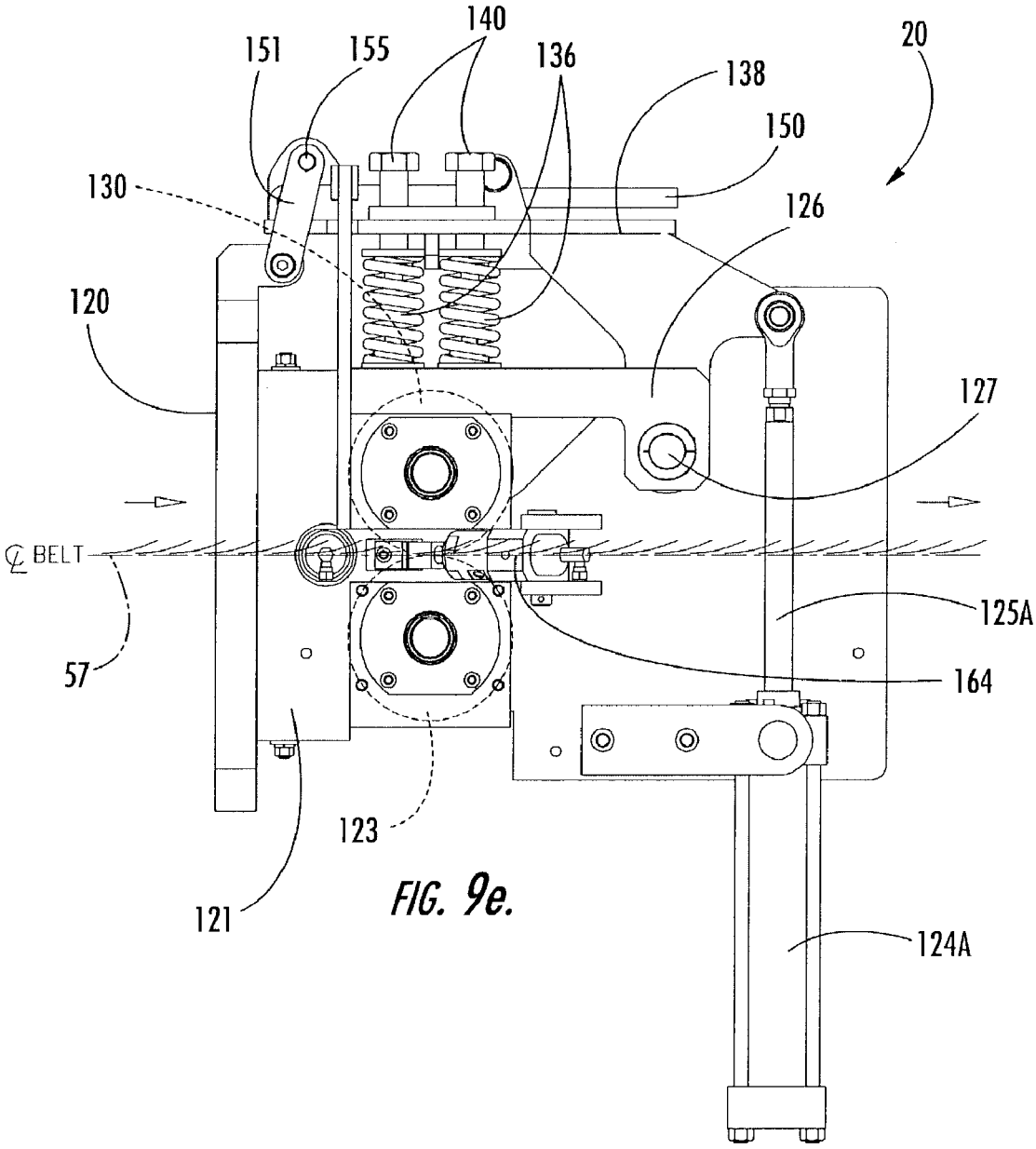
FIG. 9*e* is a side elevation of the sealing head in the closed, sealing position.
Figure 9F:
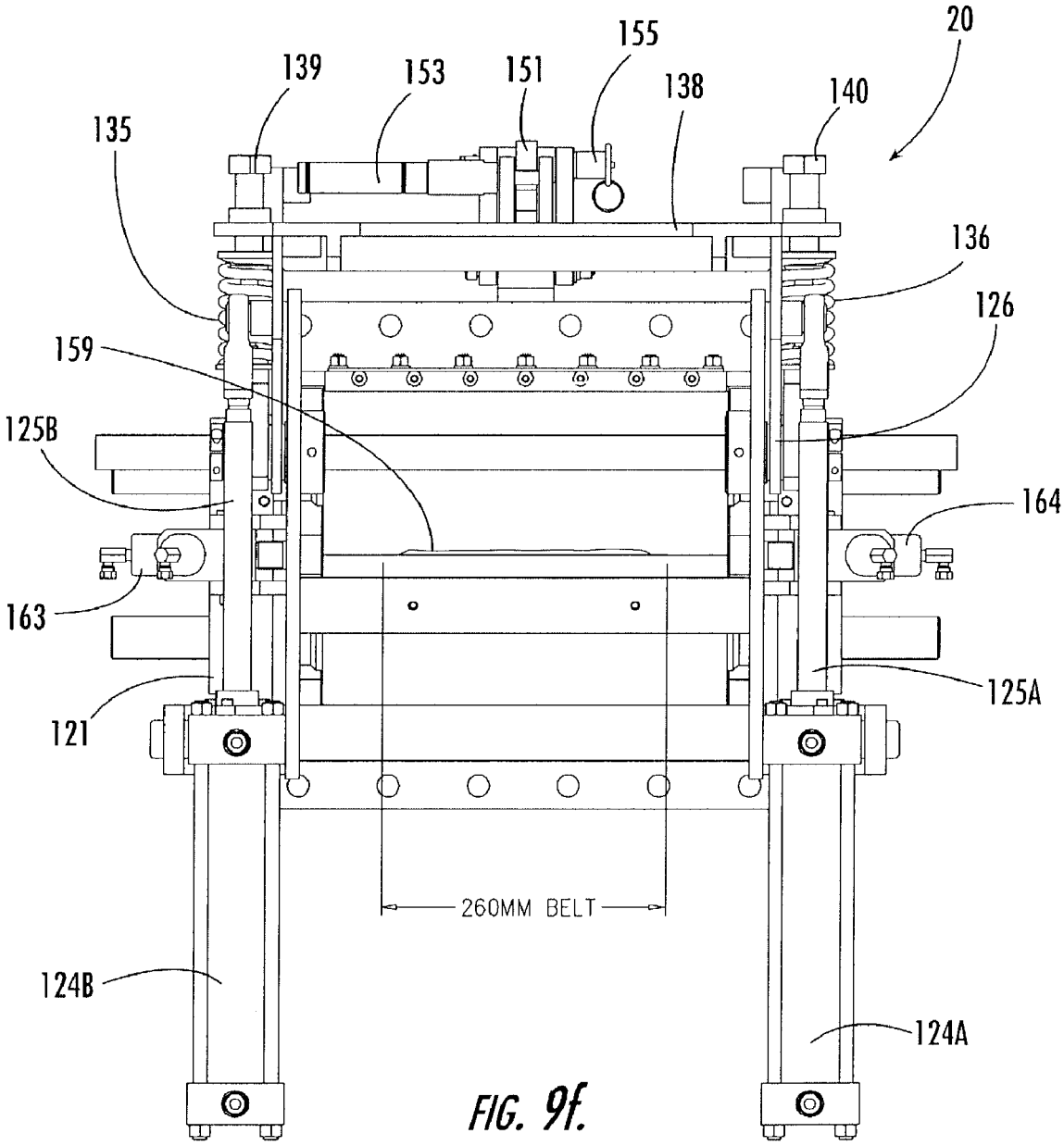
FIG. 9*f* is a front elevation of the sealing head in the closed, sealing position.

Yarn passing through the entrance sealing roll assembly 20 on the conveyor belt 57 is compressed as it passes between the top and bottom sealing rolls 130, 123 to the extent that pressure cannot escape past the compressed yarn. FIG. 9*e*. Thus, the pressurized interior of the heat set tunnel 10 is effectively sealed at the entrance end from the surrounding atmosphere.

The entire entrance sealing roll assembly 20 can be covered by a protective shroud 170, as shown in FIG. 13. FIG. 9*a*.

As noted above, an identical exit roll sealing assembly 30 positioned in the exit end of the heat set tunnel 10 performs the identical function at the exit end, creating a closed environment for the heat set operation.

A heat setting machine with a sealing head is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A continuous heat set line for setting yarn, comprising:

(a) spaced-apart, elongate, tubular entrance and exit cooling chambers interconnected by an elongate intermediate steam heat-setting chamber communicating therewith, said entrance and exit cooling chambers and said intermediate heat-setting chamber collectively defining a single longitudinally-extending axis along the combined length thereof;

(b) a steam injector for injecting steam at a predetermined pressure into the heat-setting chamber;

(c) sealing means for sealing the entrance and exit cooling chambers and the intermediate heat-setting chamber to a degree sufficient to maintain a pressurized condition within the heat-setting chamber;

(d) a yarn conveyor extending through the entrance and exit cooling chambers and the intermediate heat-setting chamber for conveying the yarn therethrough;

(e) a yarn depositing apparatus for depositing yarn in a uniform manner on the yarn conveyor upstream of the entrance sealing means; and (f) a cooling assembly exterior to and communicating with at least the entrance cooling chamber for:

(i) circulating cool, dry air through yarn in the entrance cooling chamber;

(ii) providing additional space within the entrance cooling chamber for non-cooling assembly components; and (iii) allowing the entrance cooling assembly to be sized for optimum cooling capacity independent of entrance cooling chamber volume, yarn conveyor width and yarn conveyor position within the entrance cooling chamber.

2. A continuous heat set line according to claim 1, wherein said yarn depositing apparatus comprises a yarn coiler for depositing uniform, overlapping coils of yarn on the yarn conveying apparatus.

3. A continuous heat set line according to claim 1, and including:

(g) a cooling assembly exterior to and communicating with the exit cooling chamber for:

(i) circulating cool, dry air through yarn in the exit cooling chamber;

(ii) providing additional space within the exit cooling chamber for non-cooling assembly components; and (iii) allowing the cooling assembly to be sized for optimum cooling capacity independent of exit cooling chamber volume, yarn conveyor width and yarn conveyor position within the exit cooling chamber.

4. A continuous heat set line according to claim 1, and including a yarn packaging apparatus for removing the yarn from the yarn depositing apparatus and forming the yarn into a package suitable for further downstream processing.

5. A continuous heat set line according to claim 1, wherein said sealing means comprises an entrance sealing roll apparatus positioned upstream of the entrance cooling chamber and an exit sealing roll apparatus positioned downstream of said exit cooling chamber for sealing, respectively, the upstream end of the entrance cooling chamber and the downstream end of the exit cooling chamber, each of the entrance and exit sealing roll apparatuses including a pair of sealing rolls positioned adjacent each other for allowing yarn on the conveying apparatus to pass therebetween while preventing the escape of pressurized steam from within the entrance and exit cooling chambers and the intermediate steam heat-setting chamber.

6. A continuous heat set line according to claim 1, wherein the yarn conveyor extends through the entrance and exit cooling chambers and said intermediate heat-setting chamber at a position equidistant from a top and bottom wall thereof.

7. A continuous heat set line according to claim 1, wherein the sealing means comprise:

(a) a frame defining an opening through which the conveyor extends;

(b) a bottom sealing roll assembly carried by the frame, including a rotatably-mounted bottom sealing roll positioned below the conveyor;

(c) a top sealing roll assembly carried by the frame, and including a rotatably-mounted top sealing roll mounted in spaced-apart relation to the bottom sealing roll above the conveyor whereby the conveyor extends between the bottom sealing roll and the top sealing roll for carrying the yarn past the top and bottom sealing roll assemblies and into the entrance cooling chamber;

(d) at least one piston and cylinder assembly interconnecting the frame and the top sealing roll assembly for moving the top sealing roll assembly between an opened position, and a closed position wherein the top roll rests against the bottom roll; and (e) pressurizing means for exerting sufficient pressure on the top roll to seal the top roll against the conveyor and the yarn carried thereon as the conveyor is supported by the bottom roll.

8. A continuous heat set line according to claim 7, wherein said pressurizing means comprises springs carried by the frame for resiliently biasing the top roll against the yarn and conveyor when in its closed position.

9. A continuous heat set line according to claim 8, wherein the sealing means includes lateral seals positioned to contact and seal against radially-extending end walls of the top roll and the bottom roll.

10. A continuous heat set line according to claim 1, and including a locking lever for urging the top roll into contact with the conveyor.

11. A continuous heat set line according to claim 10, and including a locking pin for locking the locking lever into a position with the top roll urged into contact with the conveyor.

12. A continuous heat set line according to claim 1, and including a top lamella sealingly engaging the top roll along the length thereof to prevent the escape of steam and pressure past the top roll and a bottom lamella sealingly engaging the bottom roll along the length thereof to prevent the escape of steam and pressure past the bottom roll.

13. continuous heat set line for setting yarn, comprising:

(a) spaced-apart, elongate, tubular entrance and exit cooling chambers interconnected by an elongate intermediate steam heat-setting chamber communicating therewith, said entrance and exit cooling chambers and said intermediate heat-setting chamber collectively defining a single longitudinally-extending axis along the combined length thereof;

(b) a steam injector for injecting steam at a predetermined pressure into the heat-setting chamber;

(c) sealing means for sealing the entrance and exit cooling chambers and the intermediate heat-setting chamber to a degree sufficient to maintain a pressurized condition within the heat-setting chamber;

(d) a steam pretreatment chamber positioned upstream of the entrance cooling chamber for applying a conditioning charge of steam to the yarn before it enters the entrance cooling chamber;

(e) a yarn conveyor extending through the pretreatment chamber, the entrance and exit cooling chambers and the heat-setting chamber for conveying the yarn there through;

(f) a yarn depositing apparatus for depositing yarn in a uniform manner on the yarn conveyor upstream of the pretreatment chamber; and (g) a cooling assembly exterior to and communicating with both the entrance cooling chamber and exit cooling chamber for:

(i) circulating cool, dry air through yarn in the entrance and exit cooling chambers;

(ii) providing additional space within the entrance and exit cooling chambers for non-cooling assembly components; and (iii) allowing the cooling assembly to be sized for optimum cooling capacity independent of the entrance and exit cooling chamber volume, yarn conveyor width and yarn conveyor position within the entrance and exit cooling chambers.

* * * * *

UNITED STATES PATENT AND TRADEMARK OFFICE

CERTIFICATE OF CORRECTION

PATENT NO. : 7,219,516 B2
APPLICATION NO. : 10/392497
DATED : May 22, 2007
INVENTOR(S) : Rhyne et al.

It is certified that error appears in the above-identified patent and that said Letters Patent is hereby corrected as shown below:

Column 8, line 10, delete “(g)” and enter --"(a)"--.

Column 9, line 20, before the word “continuous” enter --"A"--.

Signed and Sealed this

Tenth Day of July, 2007

JON W. DUDAS
*Director of the United States Patent and Trademark Office*